United States Patent [19]

Walters

[11] 4,276,919

[45] Jul. 7, 1981

[54] ENCLOSURE DOORS

[76] Inventor: Kenneth I. Walters, Philadelphia, Pa.

[21] Appl. No.: 974,025

[22] Filed: Dec. 28, 1978

Related U.S. Application Data

[63] Continuation of Ser. No. 807,160, Jun. 16, 1977.

[51] Int. Cl.[3] ..... E05D 15/26

[52] U.S. Cl. ..... 160/206; 160/199; 160/235

[58] Field of Search ..... 160/183, 196, 199, 206, 160/231 R, 235, 372, 374; 292/251.5; 49/409–411, 505

[56] References Cited

U.S. PATENT DOCUMENTS

| | | | |
|---|---|---|---|
| 845,418 | 2/1907 | Johnson | 160/206 |
| 2,331,822 | 12/1943 | Zechiel et al. | 160/206 |
| 2,642,018 | 6/1953 | Weeber | 160/235 |
| 2,850,332 | 9/1958 | Begle | 160/235 |
| 2,909,802 | 10/1959 | Gang et al. | 49/411 |
| 3,062,279 | 11/1962 | Kochanowski | 160/196 |
| 3,111,208 | 11/1963 | Grossman | 49/505 |
| 3,205,935 | 9/1965 | Cayton | 160/183 |
| 3,260,788 | 7/1966 | Stetson | 292/251.5 |
| 3,359,594 | 12/1967 | Pastoor | 160/235 |
| 3,720,255 | 3/1973 | Ueda | 160/199 |
| 3,783,930 | 1/1974 | Williams | 160/206 |
| 3,987,837 | 10/1976 | Hewson | 160/206 |

*Primary Examiner*—Peter M. Caun

*Attorney, Agent, or Firm*—Weiser, Stapler & Spivak

[57] ABSTRACT

An enclosure for a tub or shower comprising a pair of sliding doors which can fold relative to each other along a vertical junction. Each door is supported by an offset hanger and is pivotal about its hanger. The hangers include rollers which slide within an overhead track. The doors can be functioned to slide along the track, to pivot about the hangers and to fold together to fully expose the interior of the enclosure.

2 Claims, 8 Drawing Figures

ENCLOSURE DOORS

This is a continuation of application Ser. No. 807,160, filed June 16, 1977.

BACKGROUND OF THE INVENTION

The invention relates generally to the field of enclosures, and more particularly, is directed to an enclosure including doors that are designed to slide, pivot and fold together and which can be moved to an open position adjacent the jamb on either side of the opening.

It has been the common practice to provide one or more doors to enclose shower stalls or bathtubs. The doors can be opened to allow access to the interior compartment and can be closed to complete the enclosure to prevent water or spray from escaping from the shower or tub.

In a common type of enclosure, usually employed for use with bathtub and shower combinations, two separate, independent doors are movable within vertically aligned tracks wherein the doors can slide independently of each other. Other enclosures have been provided wherein two separate doors are equipped with hardware that permit the doors to slide and pivot independently of each other. A third type of enclosure comprises two doors that are hinged together and which are equipped with slide mechanisms that permit the doors to slide and fold against one wall.

The patent to Walters, U.S. Pat. No. 3,188,699, and the references cited therein are exemplary of prior art devices which have been developed by prior workers in the field in attempts to provide a suitable pivoting and sliding type enclosure door to thereby permit more complete access to the interior of the enclosure. All of these prior art devices are deficient or difficult in operation in that the doors must be pivoted individually, that expensive and complicated mechanisms are required or that maximum access to the enclosed interior areas cannot be achieved.

SUMMARY OF THE INVENTION

The present invention relates generally to the field of shower or tub enclosures, and more particularly, is directed to an enclosure including bi-folding, sliding doors wherein the doors are capable of being folded together and moved against either side of the enclosure.

The present invention utilizes a pair of glass or other panel doors which are pivotally interconnected along facing longitudinal edges by a vertical key which is designed to position the doors in a common vertical plane when in the closed position and to permit the doors each to pivot through an angle of substantially ninety degrees from the vertical plane when the doors are pivoted to the open position.

Each door includes an upper hanger and the door is pivotable about its hanger. The hangers include wheels, rollers or other devices which are suspended within an upper track in a manner to allow sliding movement of the doors relative to the enclosure.

The vertical edge of each door remote from the central key is equipped with a magnet and the enclosure jambs are suitably equipped with cooperating magnetically attractive material whereby the magnets act to lock the doors in closed, juxtaposed, aligned position. By pushing inwardly on the vertical key, the doors can be pivoted about their respective hangers with sufficient force to break the magnetic attraction at the jambs to thus move the doors to an open position.

In a preferred embodiment, the jambs of the enclosure are equipped with stationary members which are rigidly affixed to permanent construction about the shower or tub enclosure. Frame jamb members of cooperating shape are a horizontal sliding fit within the stationary members to thereby facilitate easy lateral adjustment at the jamb to accommodate the size of the door to the size of the opening and further to permit easy adjustment in the event that one or both sides of the enclosure are imperfectly constructed, for example, being uneven or out of plumb.

It is therefore an object of the present invention to provide an improved enclosure including bi-folding, sliding doors of the type set forth.

It is another object of the present invention to provide a novel enclosure including bi-folding sliding doors wherein a pair of doors are pivotally interconnected by a vertical key.

It is another object of the present invention to provide a novel enclosure including bi-folding sliding doors wherein means are provided to permit a pair of doors to slide, pivot and fold together and wherein the doors can be moved to an open position against either jamb defining the opening.

It is another object of the present invention to provide a novel enclosure including bi-folding sliding doors wherein a pair of doors are equipped to fold together along mating vertical edges and wherein each door is pivotally and slidingly carried by a top hanger.

It is another object of the present invention to provide a novel enclosure including bi-folding sliding doors wherein a pair of doors are pivotally interconnected along mating, vertical edges by a vertical key and wherein the key is provided with handle means to facilitate pivotal operation from either within or without the enclosure.

It is another object of the present invention to provide a novel enclosure including bi-folding sliding doors wherein framing members comprise an upper track within which door hangers are slidable, a lower track within which door bottom pivots are slidable and right and left jamb members, the jamb members being provided with lateral adjustment means to facilitate field installation.

It is another object of the present invention to provide a novel enclosure including bi-folding sliding doors that is inexpensive in construction, simple in design and trouble free when in use.

Other objects and a fuller understanding of the invention will be had by referring to the following description and claims of a preferred embodiment thereof, taken in conjunction with the accompanying drawings, wherein like reference characters refer to similar parts throughout the several views and in which:

DESCRIPTION OF THE PREFERRED EMBODIMENT OF THE INVENTION

Figure 1:
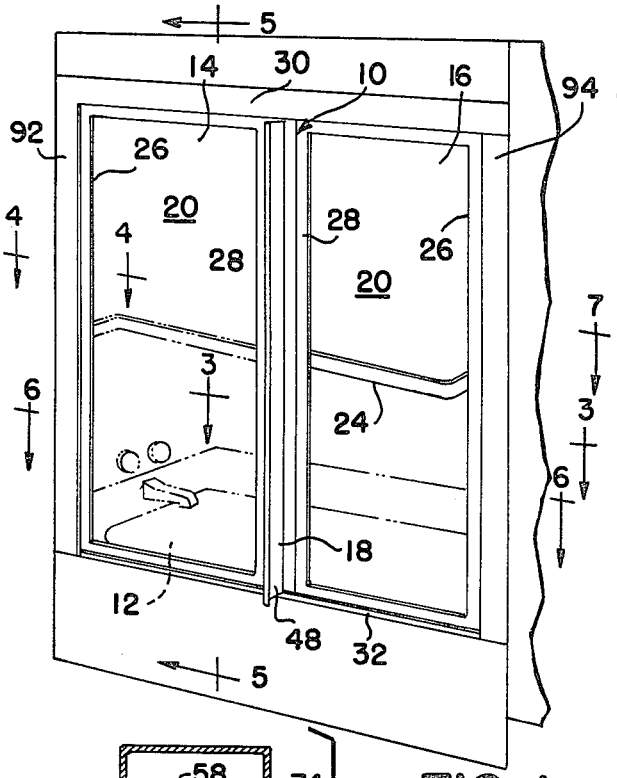
FIG. 1 is a perspective view showing the enclosure of the present invention in closed position.

Although specific terms are used in the following description for the sake of clarity, these terms are intended to refer only to the particular structure of the invention selected for illustration in the drawings, and are not intended to define or limit the scope of the invention.

Figure 2:
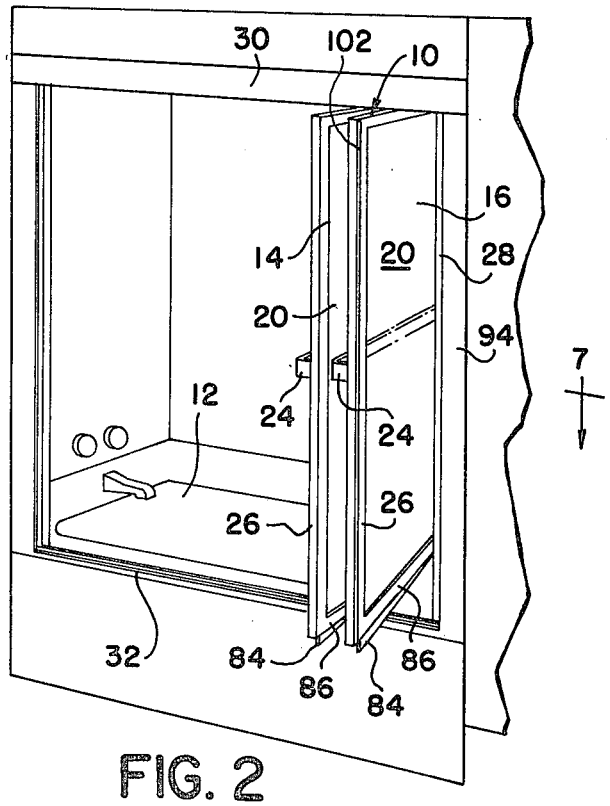
FIG. 2 is a view similar to FIG. 1, showing the doors pivoted to an open position and moved within the upper and lower tracks to a location adjacent one jamb.

Referring now to the drawings, there is shown in FIGS. 1 and 2 an enclosure 10 applied to a bath tub 12 in accordance with the present invention. Enclosure 10 comprises a pair of sliding and pivotal doors 14, 16 which are arranged in adjacent, pivotal relationship about the vertical handle 18 in the manner hereinafter more fully set forth. While the invention is illustrated in conjunction with a bathtub 12, it will be appreciated that the pivotally interconnecting doors 14, 16 may also be applied to other enclosures such as shower stalls, closets, rooms and the like when so desired.

In the embodiment illustrated, each door 14, 16 is similarly fabricated and includes generally a planar medial area 20 which preferably is fabricated of a clear sheet material. Each door is conventionally, peripherally enclosed by a frame 22 which may be fabricated of extruded or otherwise formed aluminum or other framing members. A hand rail 24 horizontally extends between the respective left and right framing members 26, 28 to provide a convenient area to grasp the doors for the usual purposes or for hanging towels. The doors 14, 16 are pivotally and slidingly arranged between an upper track 30 and a lower track 32 in the manner hereinafter more fully set forth.

Figure 3:
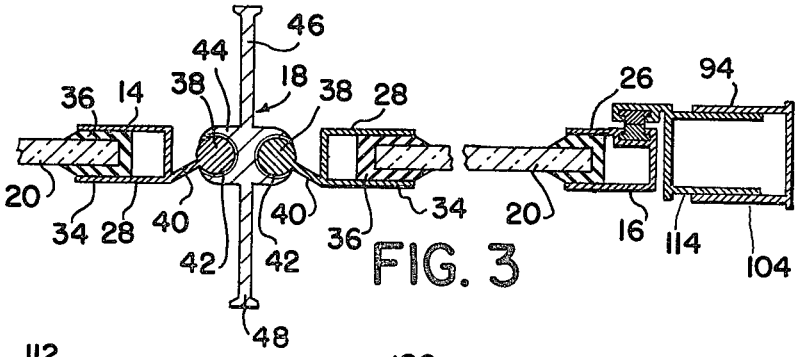
FIG. 3 is an enlarged, partial, cross sectional view taken along Line 3—3 of FIG. 1, looking in the direction of the arrows.
Figure 4:
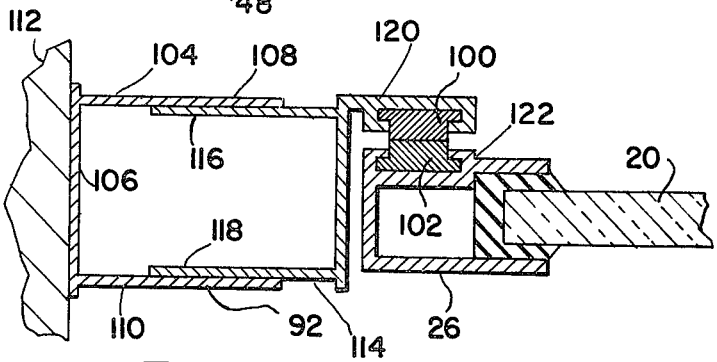
FIG. 4 is an enlarged, partial, cross sectional view taken along Line 4—4 of FIG. 1, looking in the direction of the arrows.
Figure 6:
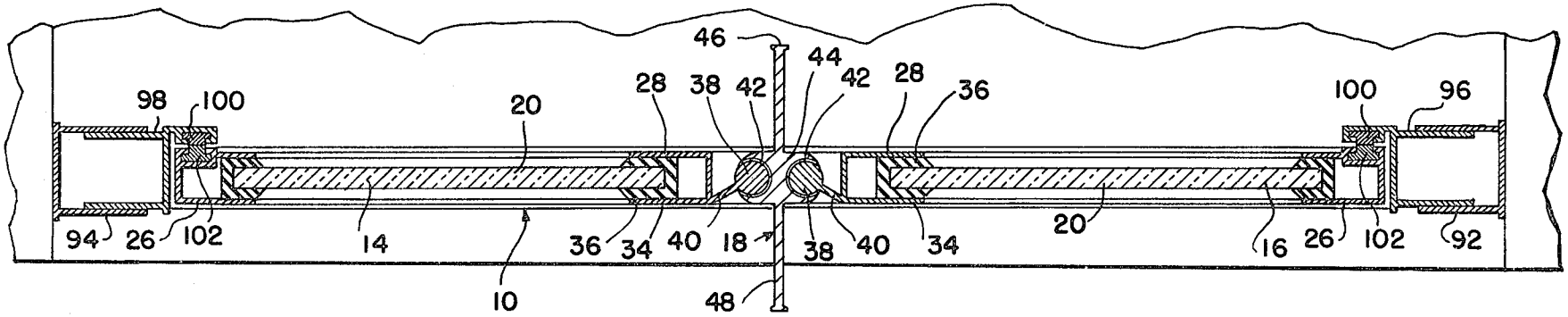
FIG. 6 is an enlarged, partial, cross sectional view taken along Line 6—6 of FIG. 1, looking in the direction of the arrows.
Figure 7:
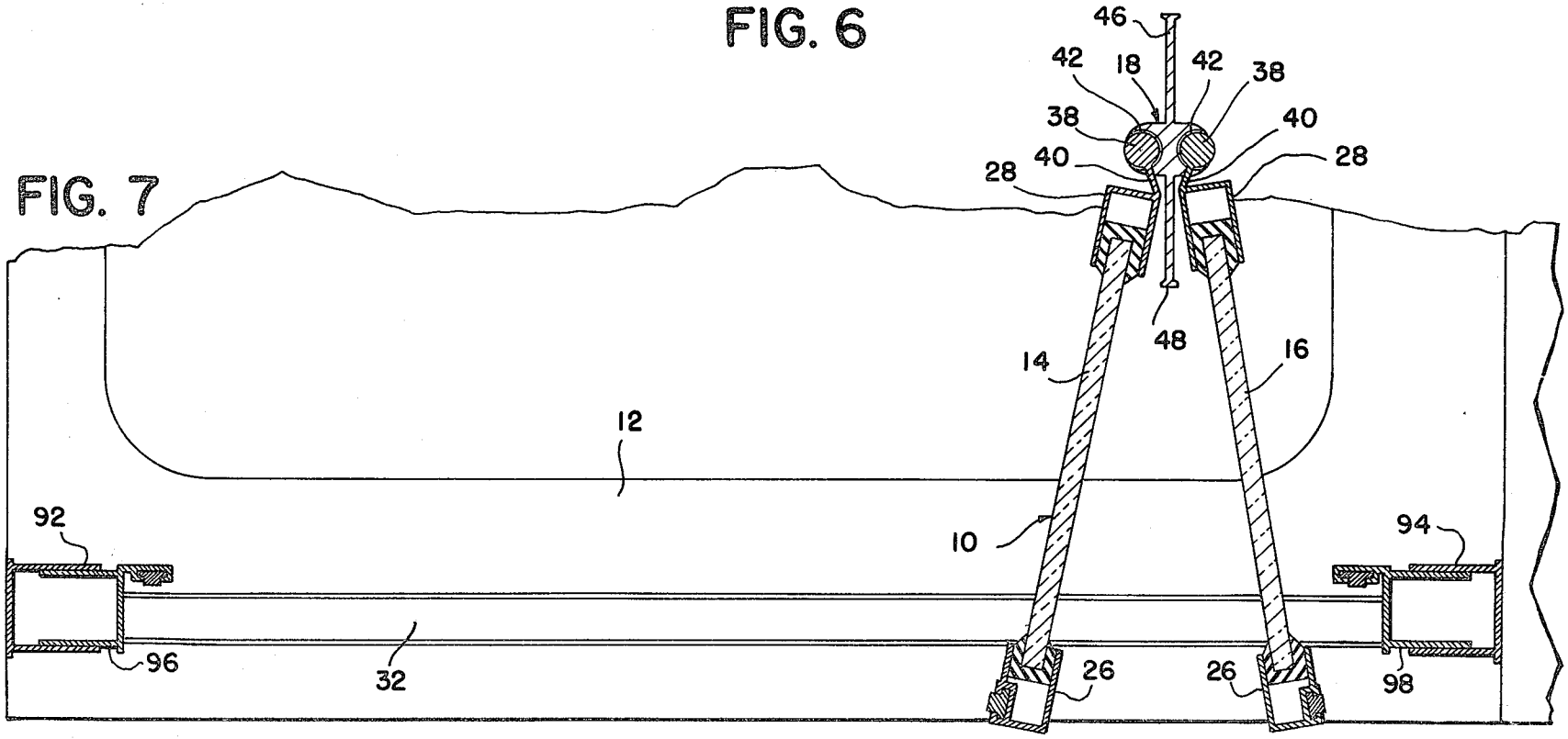
FIG. 7 is an enlarged, partial, cross sectional view taken along Line 7—7 of FIG. 2, looking in the direction of the arrows.

Referring now to FIGS. 3, 6 and 7, it will be observed that each vertical, interior frame member 28 of the doors 14, 16 is extruded or otherwise formed to provide a glass receiving socket 34 which faces inwardly of the respective door to conventionally receive and retain a glass or other panel 20. A vinyl or other resilient retainer 36 peripherally fills the socket 34 between the panel 20 and the vertical frame member 28 in conventional manner to securely hold the panel 20 in a water tight construction.

The interior frame members 28 are extruded or otherwise formed to provide an upwardly spaced, vertical, cylindrical hinge 38 which is interconnected through the angular extension arm 40 for pivotal interconnection with the handle 18. As illustrated, the handle 18 is provided with a pair of similar, opposed, vertical sockets 42 of size to closely overfit each respective cylindrical hinge 38 in a pivotal interconnection. Thus, both of the doors 14, 16 can be readily pivoted relative to the handle 18 through interaction of the hinges 38 within the respective vertical sockets 42. The angular orientation of an extension arm 40 relative to the planar alignment of a frames 22 facilitates substantially ninety degree pivoting of the doors 14, 16, as illustrated in FIG. 7 from the planar alignment of FIG. 6.

The handle 18 includes a medial portion 44 within which the respective left and right vertically extending sockets 42 are formed. Extending inwardly at substantially ninety degrees from the plane of the doors is a vertical inner handle 46. An exterior vertical handle 48 extends outwardly from the medial portion 44 in planar alignment with the inner handle 46. Preferably, the cylindrical hinge 38 and vertical socket 42 construction facilitates assembly of the parts in an easy, inexpensive manner simply by applying the hinge member at the tops or bottoms of the doors 14, 16 and then sliding the hinge vertically relative to the doors until the parts align. It is thus seen that a hinged connection can be made with extruded, shaped parts without the need for employing threaded fasteners which were required by prior art type of piano hinges. The interior and exterior handles or grips 46, 48 extend the full vertical height of the doors 14, 16 to provide a ready area for grasping and operating the enclosure assembly 10 whether from within or without the enclosure.

Figure 5:
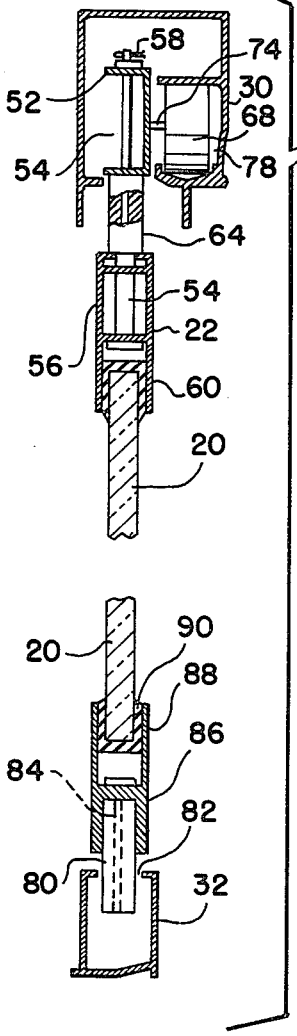
FIG. 5 is an enlarged, partial, cross sectional view taken along Line 5—5 of FIG. 1, looking in the direction of the arrows.
Figure 8:
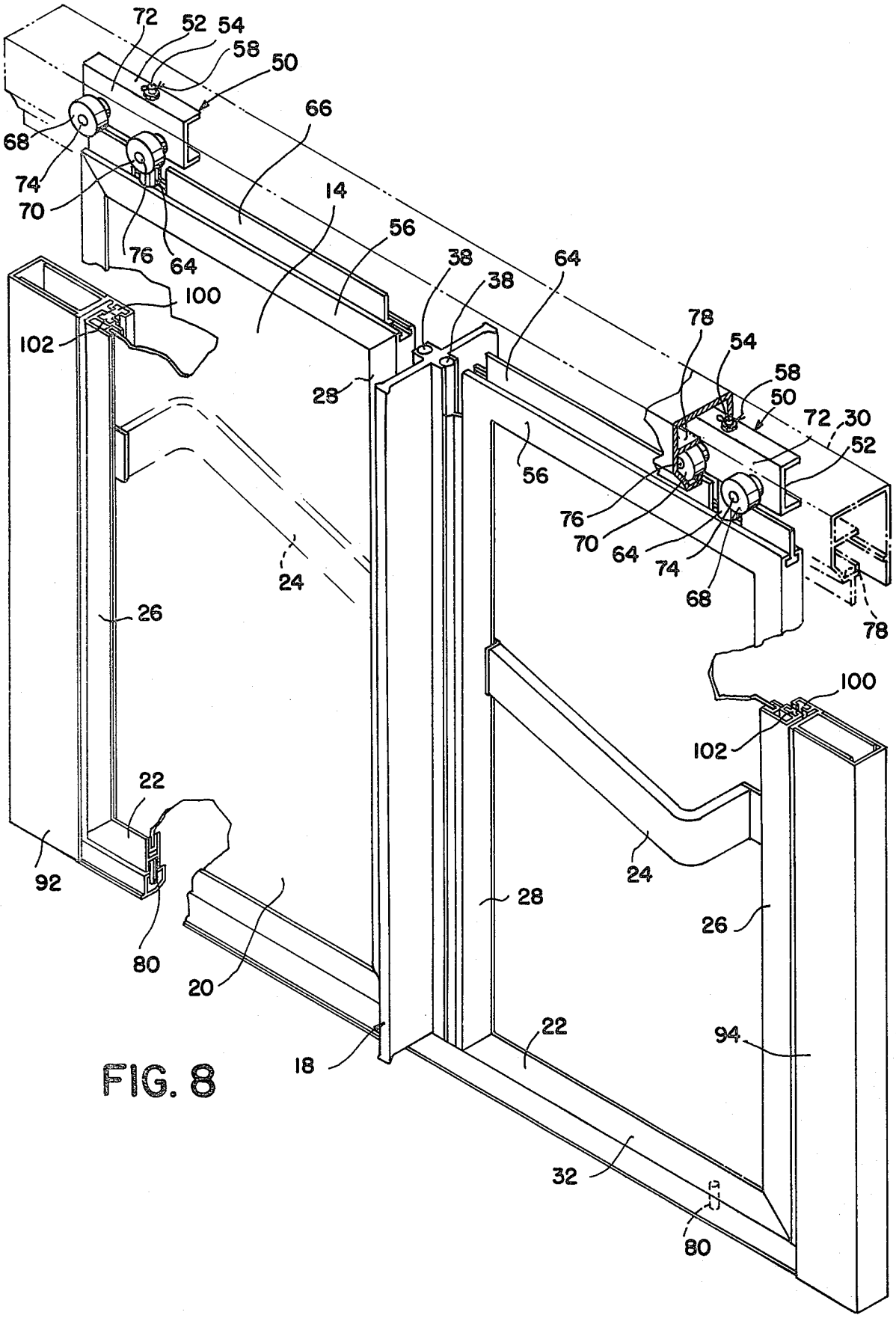
FIG. 8 is an enlarged, perspective view of the doors and hardware, parts of which have been broken away to expose interior construction details.

Referring now to FIGS. 5 and 8, the suspension system of the doors 14, 16 will be described in detail. As illustrated, upper carriers or hangers 50 upwardly extend from each door 14, 16 and comprise generally a channel shaped body 52. A connector 54, which may be in the form of a bolt or other strong, elongated member interconnects each door frame at a respective frame head 56 with a channel shaped body 52 and may be secured thereto in conventional manner, such as by employing a cotter pin 58 or other suitable securing construction. The frame head 56 comprises a conventional socket 60 and resilient filler 52 to secure the glass panel 20 therewithin in conventional manner. If desired, a spacer 64 may be employed between the frame head 56 and the bottom of the upper carrier 50 to hold the parts in desired vertical juxtaposition.

As illustrated, the connector 54 is positioned transversely outwardly from the vertical medial axis of each door 14, 16 to facilitate pivotal operation and to permit pivoting with a minimum of effort. The connector 54 is positioned inwardly of the vertical medial axis through the upper carrier 50 to further facilitate the pivotal operation of the device and to provide maximum stability. A transversely extending, upwardly oriented vinyl seal 66 is affixed to the top of each head 56 in conventional manner to provide a substantially leak proof top junction between each door 14, 16 and the upper track 30. The vinyl seal 66 may be split as necessary to facilitate installation of the spacer 64. See FIG. 8. Preferably, the seal 66 extends above portions of the upper track construction 30 to prevent passage of water from within the enclosure to escape outwardly by passing over the doors 14, 16 at the upper track.

Each upper carrier 50 supports a pair of plastic or other material wheels or rollers 68, 70 which preferably are journalled in the web 72 of each of the channel shaped bodies 52. Respective wheel shafts 74, 76 are secured within the web 72 to facilitate a wheel rotation thereabout. As best seen in FIG. 5, the wheels 68, 70 ride within a horizontal roller space 78 which is extruded or otherwise formed in the upper track 30 in a manner to impart easy, horizontal, sliding motion to the doors 14, 16. The upper track 30 is conventionally secured in spaced relationship above the bathtub 12, in a sturdy manner to fully support the doors 14, 16 during all periods of use.

Still referring to FIGS. 5 and 8, it will be seen that the bottom pivot pins 80 are vertically aligned below the pivotal connectors 54 and these pins 80 are positioned in horizontal sliding arrangement within the transverse opening 82 defined in the bottom or lower track 32. The sill members 86 which comprise the bottom member of the door frames 22 downwardly carry a transverse vinyl or other waterproof material seal 84 which projects downwardly through the opening 82 to prevent water from splashing under the doors 14, 16 at the respective bottoms thereof. The vinyl seals 84 may be split as necessary about the lower pivot pins 80 in well known manner. In conventional manner, each sill frame member 86 comprises an upwardly open socket 88 to receive the medial panel 20 therein in a secure, water resistant connection. A suitable water resistant filler 90, such as a resilient vinyl, seals the interconnection between the glass panel 20 and the frame member socket 88.

Thus, as best seen in FIG. 8, the doors 14, 16 are suspended respectively from upper carriers 50 and are respectively pivotal about the vertically aligned upper connectors 54 and bottom position pivot pins 80 from the fully closed position illustrated in FIGS. 1 and 6 to the fully open or pivotal position illustrated in FIGS. 2 and 7. It will be noted that the upper wheels 68, 70 ride within the track roller area 78 and accordingly, the channel shaped bodies 52 are slidingly arranged relative to the upper track 30 and remain in longitudinal alignment with respect thereto under all conditions of use. By grasping a respective handle grip 46 or 48 and either pushing or pulling as necessary, the doors 14, 16 can be pivoted relative to the upper and lower tracks 30, 32. When the doors are pivoted as illustrated in FIGS. 2 and 7, transverse movement of the doors can be readily achieved by sliding the pivoted doors along the upper and lower tracks 30, 32 until they are adjacent either the left edge jamb 92 or the right jamb 94.

The framing at each jamb 92, 94 includes a vertical, channel-shaped mounting strip 104 comprising a web 106 and a pair of spaced legs 108, 110 which extend inwardly from web to define an opening therebetween. The mounting strip may be conventionally secured to the existing construction 112 by suitable fasteners such as sheet metal screws, toggle bolts or the like (not shown) which project through the web 106 and affix into the stationary construction 112. An adjustable, jamb strip 114 includes a pair of spaced, outwardly projecting legs 116, 118 which are spaced apart a predetermined distance to be a tight, sliding fit within the legs 108, 110 of the strip 104. In this manner, considerable lateral adjustment of the adjustment strip 114 within the vertical mounting strip 104 can be achieved to thereby vary the clear opening defined between the jambs 92, 94 to provide for optimum fitting of the doors 14, 16 directly at the job site. In this manner, by providing considerable lateral adjustment, for example two inches at each jamb, the opening width can be easily adjusted during installation to accommodate the doors with considerable adjustibility to compensate for irregularities in the permanent construction 112, certain inaccuracies in measurement, etc. When the desired clear width between the respective left and right adjustment strips has been established, these strips 114 can be secured in place by driving fasteners through adjacent legs 116, 108 or 118, 110 of the respective right and left adjustment strips 114 and the cooperating fixed mounting strips 104.

As illustrated in FIGS. 3, 4, 6 and 7, the adjustment strips 114 are extruded or otherwise formed to provide an inwardly projecting socket 120 which vertically extends and within which is mounted a vertical magnet 100. Cooperating vertical magnets 102 are carried by vertical sockets 122 which are extruded or otherwise formed in the door exterior, vertical frame members 26. As shown, when the doors 14, 16 are arranged in planar alignment in the manner illustrated in FIGS. 3, 4 and 6 to enclose the tub or shower area, the magnets 100 register with the magnets 102 to thereby lock the doors in the closed position and thus resist opening pressures. By applying inwardly directed forces upon the handle grip 46 or 48, the doors 14, 16 will tend to pivot about the upper connector 54 and the bottom pivot pin 80. When the forces applied at the handle grips 46, 48 are sufficient to overcome the attraction between the magnetic fasteners or locks 100, 102, the doors 14, 16 can then be pivoted to the open position. (See FIGS. 2 and 7).

Although the invention has been described with a certain degree of particularity, it is understood that the present disclosure has been made only by way of example and that numerous changes in the details of construction and the combination and arrangements of parts may be resorted to without departing from the spirit and scope of the invention. Thus, the scope of the invention should not be limited by the foregoing specification, but rather only by the scope of the claims appended hereto.

What is claimed is:

1. In an enclosure of the type having an opening defined laterally between right and left jambs and vertically defined between an upper track and a lower track, the combination of a first door and a second door suspended from said upper track, each of said doors having respective inward and outward right and left vertical framing members and a vertical medial axis, said doors being pivotal from a first position wherein the doors position in planar alignment to substantially close the opening to a second, pivotal position wherein the doors are angularly arranged relative to the upper track to expose the opening;

a handle pivotally connecting the first and second doors, said handle including means adapted to pivotally hold each door to permit each door to pivot relative to the upper track between the said first and second positions, hanger means connected to each door, part of said hanger means being in sliding relation within the upper track, the hanger means being adapted to slide the doors between the right and left jambs when the doors are pivoted to the said second position, and a pivot pin connected to the bottom of each door, the pivot pin being in sliding relation within the lower track, the pivot pin being in vertical alignment below the hanger means, said hanger means and pivot pin being laterally offset from the medial axis of its associated door, said hanger means being positioned between a right or left vertical framing member and the medial axis, each door being adapted to pivot about its said hanger means;

magnetic lock means to lock the doors in the first position, said magnetic lock means comprising a movable first magnet means affixed to a movable jamb strip and a second magnet means affixed to a door, said first magnet means being movable to a position to be attracted to the second magnet means when the doors are in the said first position; and means to laterally adjust the position of the movable jamb strip to vary the size of the opening defined between the said jambs, whereby the doors when pivoted about the hanger means may be slidable along the tracks to a position adjacent either the right jamb or the left jamb to expose the opening.

2. The enclosure of claim 1 wherein the means to laterally adjust comprises a stationary mounting strip secured to a jamb, the stationary mounting strip comprising a first pair of spaced legs, and the said movable jamb strip movably secured to the stationary mounting strip, the movable jamb strip comprising a second pair of spaced legs being a tight sliding fit on the first pair of legs whereby the position of the movable jamb strip can laterally be adjusted relative to the position of the stationary mounting strip by sliding the first pair of legs laterally relative to the second pair of legs to vary the width of the opening.

* * * * *